US007166349B2

(12) United States Patent
Collins

(10) Patent No.: US 7,166,349 B2
(45) **Date of Patent: *Jan. 23, 2007**

(54) GRID OF SYNTHETIC MATERIAL

(75) Inventor: Thomas G. Collins, Charlotte, NC (US)

(73) Assignee: Huesker Synthetic GmbH, Gescher (DE)

( * ) Notice: Subject to any disclaimer, the term of this patent is extended or adjusted under 35 U.S.C. 154(b) by 297 days.

This patent is subject to a terminal disclaimer.

(21) Appl. No.: 10/638,713

(22) Filed: Aug. 11, 2003

(65) Prior Publication Data

US 2004/0033337 A1 Feb. 19, 2004

(30) Foreign Application Priority Data

Aug. 9, 2002 (DE) ..... 102 36 503

(51) Int. Cl.

| | |
|---|---|
| ***B32B 5/12*** | (2006.01) |
| ***D03D 25/00*** | (2006.01) |
| ***E21C 37/00*** | (2006.01) |
| ***B21F 27/00*** | (2006.01) |

(52) U.S. Cl. ..... 428/105; 139/416; 139/383 A; 139/383 AA; 139/383 R; 442/1; 299/11; 299/12; 245/1

(58) Field of Classification Search ..... 442/100, 442/59, 50, 58; 428/293.7; 139/382–386; *D04B 23/12*
See application file for complete search history.

(56) References Cited

U.S. PATENT DOCUMENTS

| | | | | |
|---|---|---|---|---|
| 5,131,434 | A * | 7/1992 | Krummheuer et al. | 139/35 |
| 6,276,174 | B1 * | 8/2001 | Wunner et al. | 66/84 A |
| 6,397,920 | B1 | 6/2002 | Forin | |
| 6,407,015 | B1 * | 6/2002 | Saika | 442/46 |
| 6,918,412 | B1 * | 7/2005 | Pintz et al. | 139/383 A |
| 2002/0153053 | A1 | 10/2002 | Pintz et al. | |

FOREIGN PATENT DOCUMENTS

| | | | |
|---|---|---|---|
| AU | 200227653 | A1 | 10/2002 |
| DE | 20 00 937 | | 7/1971 |
| DE | 75 11 351 | U1 | 4/1975 |
| DE | 41 38 506 | A1 | 9/1992 |
| DE | 41 37 310 | A1 | 5/1993 |
| DE | 199 15 722 | A1 | 10/2000 |
| DE | 198 16 440 | C1 | 8/2001 |
| DE | 100 16 792 | A1 * | 10/2001 |
| DE | 10016792 | * | 10/2001 |
| DE | 101 15 007 | A1 | 10/2002 |

* cited by examiner

*Primary Examiner*—Terrel Morris
*Assistant Examiner*—Matthew D. Matzek
(74) *Attorney, Agent, or Firm*—Muirhead & Saturnelli, LLC

(57) ABSTRACT

The invention relates to a grid of synthetic material with two groups of parallel, load-bearing strands, wherein the strands of the first group extend in the longitudinal direction of the grid and the strands of the second group extend transversely to the longitudinal direction of the grid and the strands of both groups are joined together at their points of intersection. Alternating first and second portions are formed with strands extending in the direction of one of the two groups. The strand spacing of the first portions are larger than the strand spacing of the second portions. The second portions can be of an increased strength and can be used to fasten the grid without aids.

27 Claims, 2 Drawing Sheets

GRID OF SYNTHETIC MATERIAL

BACKGROUND OF THE INVENTION

1. Technical Field

The invention relates to a grid of synthetic material with two groups of parallel, load-bearing strands, wherein the strands of the first group extend in the longitudinal direction of the grid and the strands of the second group extend transversely to the longitudinal direction of the grid and the strands of both groups are joined together at their points of intersection.

2. Description of Related Art

Grids of this kind are known from numerous documents, inter alia from DE 20 00 937, DE 41 37 310, DE 41 38 506 and DE 199 15 722 A1.

The patent application DE 101 15 007, which has not yet been published, as well as the US patent application having the application Ser. No. 10/102,889, which is based on the priority of the latter application, describe a grid in which the spacing between the warp thread strands is greater in the edge regions extending in the warp direction than in the central region. This is a grid mat, in particular for reinforcing the ground and for securing or stabilising slopes and/or for reinforcing roadway coverings. The increased spacing of the warp thread strands in the edge regions facilitates the process of passing through threading elements which join the said mats together in their edge regions. The warp thread strands are of a greater width, which increases resistance to displacement, in the edge region.

A known grid for the mining sector is fastened as a tunnel protection grid to a roof or a side wall of a tunnel. In order to fasten the grid, steel cables are pulled at regular intervals through parallel courses into such grids, these being fasted to the roof or the wall. These steel cables are capable of bearing the necessary tensile forces. However the preparation of the grid in situ during installation by fixing the steel cables involves a lot of work.

It is desirable is to provide a grid which is easier to fasten than the known grids.

SUMMARY OF THE INVENTION

According to an embodiment of the present invention, a grid is disclosed that alternately comprises first portions and second portions which extend at least in the direction of the strands of one of the two groups, wherein the strands of this group have a large spacing in the first portions and a small spacing in the second portions.

The grid can bear a greater tensile force in the second portion, in which the spacing between the adjacent, parallel strands is small. The parallel strands may, for example, be disposed substantially side by side in this portion. Maximum strength in the longitudinal direction can be achieved in this portion as a result. The actual grid is therefore formed in the above-mentioned second portions such that its strength is sufficiently high to fasten the grid for a plurality of different purposes. The grid may be fastened to walls and roofs without using steel cables, in particular in the mining sector. However the grid according to the invention may also be used to advantage in other fields of application, as its strength is increased in the region of the second portions with a small strand spacing.

The parallel strands of the group in question have a normal strand spacing between the portions with a small strand spacing. This strand spacing is defined according to the purpose and is usually between 15 and 60 mm for conventional grids.

The alternating portions extend in the longitudinal direction in a first embodiment. Consequently only the strands which extend in the longitudinal direction of the grid have spacings which differ in alternating fashion. If the longitudinal and transverse strands are joined together by a textile binding technique, e.g. weaving or knitting, the longitudinal direction corresponds to the warp direction of the textile article. DE 20 00 937, for example, discloses a woven grid in which the individual strands of the grid are held together by leno threads, which extend in the warp direction and in each case enclose a strand consisting of a plurality of warp threads. DE 199 15 722, for example, discloses textile grids in which the load-bearing warp and weft threads are joined together by warp knitting. The warp knitting technique, which is frequently also called Raschel technique, uses binding threads which form meshes enclosing the warp threads. The meshes of the binding threads are also passed around the weft threads and secure these to the warp threads in the intersection regions.

As mentioned, the warp threads are disposed with alternating large and small spacings in adjacent portions in the embodiment in question.

The invention is not, however, limited to textile grids. For example, grids made from a closed plastics film are also known. The parallel strands of a group may also have alternating large and small spacings according to the invention in these grids.

In an alternative embodiment both the longitudinal and the transverse strands may have spacings which differ in alternating fashion. In this case zones of increased tensile strength which extend at right angles to one another are produced in the grid.

In one embodiment of the grid according to the invention each strand of a thread group may consist of a plurality of single threads. A grid of this kind is known, for example, from the above-mentioned DE 20 00 937 or DE 199 15 722. In the latter publication each three warp threads form a warp thread strand, with each two weft threads forming a weft thread strand extending in the transverse direction.

In one embodiment the extent of the first portion with a large strand spacing is approximately two to six times as great as the extent of the second portion with a small strand spacing in the transverse direction of the portions. For example, the second portion with a small strand spacing and thus increased tensile strength is of a width of approximately 10–40 cm. The first portion with a large strand spacing and low tensile strength has a transverse extent of approximately 50–150 cm.

Strand spacings, for example, may be distributed over the entire width of the grid as follows: a first edge portion with a large strand spacing and a width of 60 cm, a following second portion with a small strand spacing and a width of approximately 20 cm, three successive groups, in each case consisting of a portion with a large strand spacing and a width of approximately 100 cm and a portion with a small strand spacing and a width of approximately 20 cm, a further edge portion with a large strand spacing and a width of approximately 60 cm.

This procedure results in a grid mat of a width of a total of 500 cm. The edge regions with a large strand spacing are somewhat wider than half the central regions with a large strand spacing. It is in this way possible to dispose a plurality of mat webs in overlapping fashion side by side and join the edge regions together by means of threading elements. It is thus possible to fasten grid webs which are joined together over any desired widths and which as a whole have an alternating structure, consisting of approximately 100 cm wide portions with a large strand spacing and approximately 20 cm wide portions with a small strand spacing.

The large strand spacing in the above-mentioned first portion corresponds approximately to three to ten times the width of a strand. In a practical embodiment the strands extending in the warp direction consist of two threads which together are of a width of approximately 7 mm. The strand spacing in the above-mentioned zone with a large strand spacing is approximately 35 mm and therefore five times the strand width.

The strand spacing is distinctly reduced in the above-mentioned second portion. The strands may even lie substantially side by side.

BRIEF DESCRIPTION OF THE DRAWING

An embodiment of the invention is described in the following with reference to the accompanying drawings, in which.

DETAILED DESCRIPTION OF VARIOUS EMBODIMENTS

Figure 1:
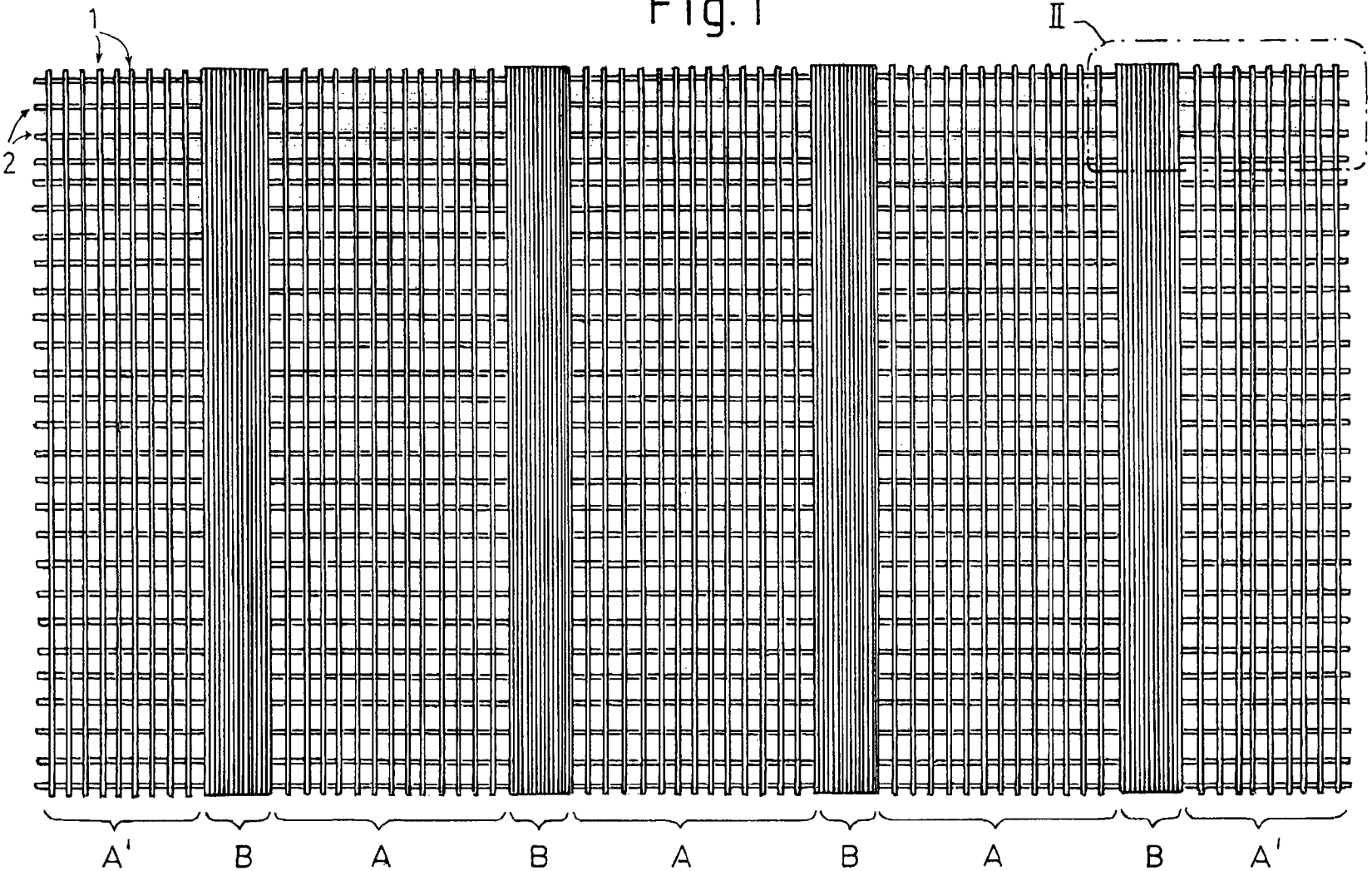
FIG. 1 is a plan view of the grid according to the invention.

Referring now to the figures of the drawing, the figures constitute a part of this specification and illustrate exemplary embodiments of the invention. It is to be understood that in some instances various aspects of the invention may be shown exaggerated or enlarged to facilitate an understanding of the invention.

FIG. 1 is a plan view onto a grid according to the invention which consists of two groups of parallel, load-bearing strands 1 and 2, wherein the strands 1 of the first group extend in the longitudinal direction of the grid and the strands 2 of the second group extend transversely to the longitudinal direction of the grid. In the case of a textile join between the strands 1 and the strands 2, the first-mentioned strands 1 extend in the warp direction and the last-mentioned strands 2 in the weft direction of the textile article. The strands 1 are joined to the strands 2 at the points of intersection. As mentioned above, when employing a textile production technique, the join may be effected by weaving and/or by means of a leno thread and/or by means of Raschel threads. Any other desired joining techniques such as gluing, bonding or producing the grid from a calendered plastics film are also possible.

The spacing between the strands 1 extending in the longitudinal direction of the grid is alternately large over a first portion A, A' and small over a second portion B. The portions are distributed as follows over the entire width of the grid:

- an edge portion A' with a large strand spacing and a width of 60 cm;
- a portion B with a small strand spacing and a width of 20 cm;
- a portion A with a large strand spacing and a width of 100 cm;
- a portion B with a small strand spacing and a width of 20 cm;
- a portion A with a large strand spacing and a width of 100 cm;
- a portion B with a small strand spacing and a width of 20 cm; and
- an edge portion A' with a large strand spacing and a width of 60 cm.

The spacing between two strands is approximately 5 cm in the region of the portions A, A' with a large strand spacing. The strands lie as close as possible side by side in the portion B with a small strand spacing.

If a plurality of grids according to the invention are laid side by side, the edge portions A' can be laid in overlapping fashion over a width of approximately 20 cm. Threading elements, which are pulled through the meshes of the grid in the overlap region, can join the overlapping edge regions together. It is in this way possible to join together a plurality of grid mat webs so as to produce 100 cm wide portions with a large strand spacing and approximately 20 cm wide portions with a small strand spacing.

The portions B with a small strand spacing obviously have a higher tensile strength than the portions with a large strand spacing. Depending on the differences between the strand spacings of the portions A, A' on the one hand and B on the other, the tensile strength of the portions B is a multiple higher than the tensile strength of the portions A, A'. In the represented embodiment the portion B has on average a number of threads extending in the longitudinal direction per unit length which is approximately eight times as great as that of the portion A or A'. Its tensile strength is consequently eight times higher, while the thread quality is the same.

It is of course additionally possible to vary the material or the thickness of the threads in the portion B with respect to the threads in the portion A, so that the tensile strength in the portion B can additionally be increased if thicker or stronger threads are selected.

Figure 2:
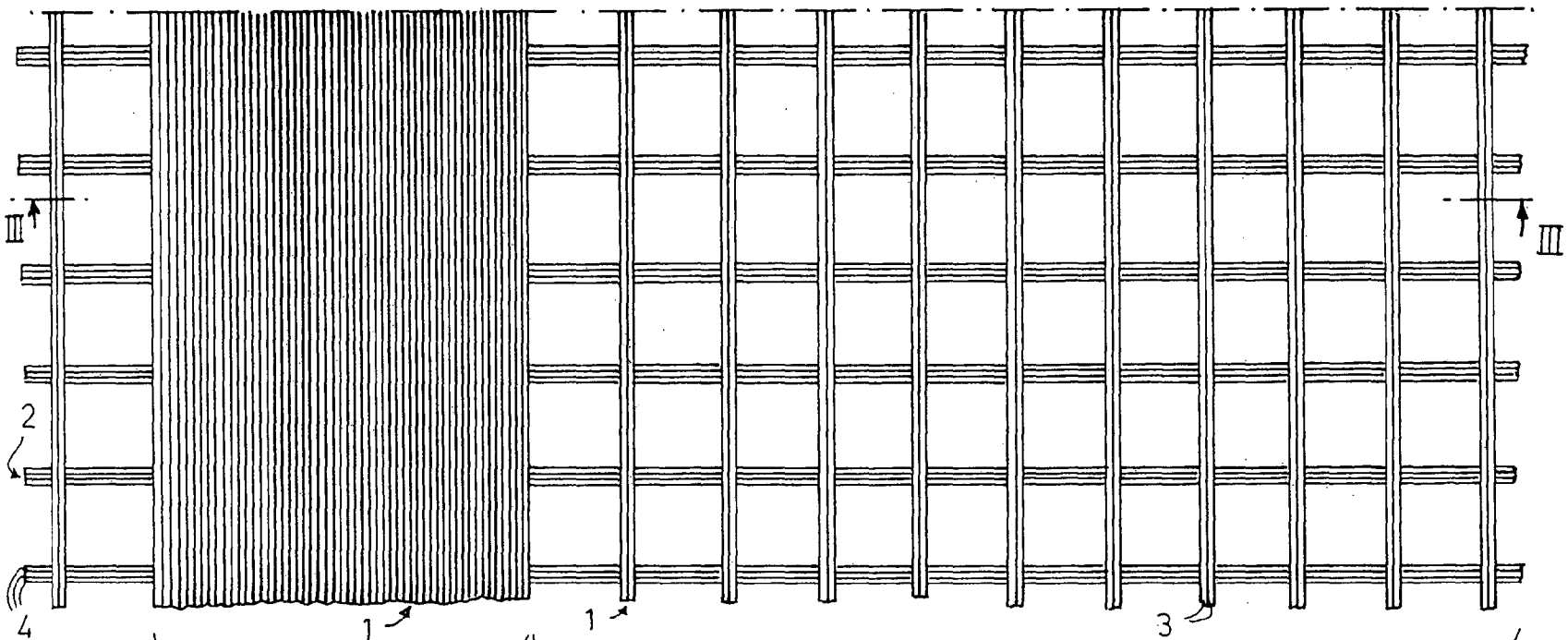
FIG. 2 is a plan view of the section II in FIG. 1.
Figure 3:
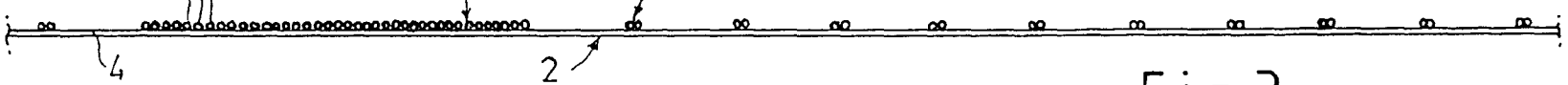
FIG. 3 is a side view of the grid portion from FIG. 2.

As shown in particular by FIGS. 2 and 3, the strands 1 extending in the longitudinal direction and the strands 2 extending in the transverse direction each comprise a plurality of single threads. Each strand 1 extending in the longitudinal direction comprises two single threads 3 in the portion A' with a large strand spacing. Each strand 2 extending in the transverse direction comprises three parallel and adjacent single threads 4.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A protection grid for mining purposes, comprising:

first and second groups of parallel, load-bearing strands, wherein the strands of the first group extend in a longitudinal direction of the grid and the strands of the second group extend transversely to the longitudinal direction of the grid and the strands of both groups are joined together at their points of intersection, and wherein the grid alternatingly includes first portions and second portions disposed adjacently with respect to one another and which extend at least in the direction of the strands of one of the two groups, wherein the strands of one of the two groups have a large spacing in the first portions between the strands and a small spacing in the second portions between the strands, said large spacing being larger in extent than said small spacing, wherein said large spacing is repeated substantially throughout said first portions and said small spacing is repeated substantially throughout said second portions, and wherein a tensile strength of each of said second portions is higher than a tensile strength of each of said first portions to allow for said second portions to be fastened to, and support a tensile load from, a wall or roof of a mining structure, wherein an extent of each of the first portions is approximately two to six times as great as an extent of each of the second portions in the transverse direction of the grid, wherein the large spacing between the strands in the first portions is approximately three to ten times a width of a strand, and wherein said width of a strand is in a range of approximately 5 mm to 16⅔ mm.

2. The grid according to claim 1, wherein the first and second portions extend in the longitudinal direction of the grid.

3. The grid according to claim 1, wherein each strand consists of a plurality of single threads.

4. The grid according to claim 1, wherein the strands lie substantially side by side in the second portions with a small strand spacing.

5. The grid according to claim 1, wherein each of the first portions has an extent in the transverse direction of approximately 50 cm to 150 cm.

6. The grid according to claim 1, wherein each of the second portions has an extent in the transverse direction of approximately 10 to 40 cm.

7. The grid according to claim 1, wherein each of the first portions has an extent in the transverse direction of approximately 50 cm to 150 cm and wherein each of the second portions has an extent in the transverse direction of approximately 10 to 40 cm.

8. The grid according to claim 1, wherein said tensile strength of each of said second portions is at least 8 times that of said tensile strength of each of said first portions.

9. A protection grid for mining purposes, comprising: a first group of parallel strands;

a second group of parallel strands that extends substantially transversely to the first group of parallel strands; and first and second portions of the second group of parallel strands that are positioned alternatingly and adjacently with respect to one another, wherein strands of the first portion have a larger spacing therebetween than strands of the second portion, wherein a first spacing between strands of the first portion is substantially repeated throughout said first portion and a second spacing between strands of said second portion is substantially repeated throughout said second portion, and wherein a tensile strength of said second portion is higher than a tensile strength of said first portion to allow for said second portion to be fastened to, and support a tensile load from, a wall or roof of a mining structure, wherein an extent of the first portion is approximately two to six times as great as an extent of the second portion in the transverse direction of the grid, wherein the large spacing between the strands in the first portion is approximately three to ten times a width of a strand, and wherein said width of a strand is in a range of approximately 5 mm to 16⅔ mm.

10. The grid according to claim 9, wherein the first group and the second group are joined together at points of intersection.

11. The grid according to claim 9, further comprising:

edge portions positioned at either end of the grid, wherein said edge portions are capable of being joined with other edge portions.

12. The grid according to claim 9, wherein said tensile strength of said second portion is at least 8 times that of said tensile strength of said first portion.

13. A protection grid for mining purposes, comprising:

a first group of parallel strands; and a second group of parallel strands extending in a transverse direction to said first group of parallel strands, wherein at least one of said first group and said second group includes at least first and second portions, said first portion including a plurality of strands and said second portion including at least one strand having a plurality of individual threads, and wherein a first spacing between adjacent strands of said first portion is greater than a spacing between adjacent individual threads of said at least one strand of said second portion, each of said plurality of individual threads being attached to said adjacent individual threads substantially along an entire length of said adjacent individual threads, and wherein a tensile strength of said second portion is higher than a tensile strength of said first portion to allow for said second portion to be fastened to, and support a tensile load from, a wall or roof of a mining structure, wherein an extent of the first portion is approximately two to six times as great as an extent of the second portion in the transverse direction of the grid, wherein the large spacing between the strands in the first portion is approximately three to ten times a width of a strand, and wherein said width of a strand is in a range of approximately 5 mm to 16⅔ mm.

14. The grid according to claim 13, wherein the first group and the second group are joined together at points of intersection.

15. The grid according to claim 13, further comprising:

edge portions disposed at either end of said grid, wherein said edge portions of said grid are connectable to edge portions of another grid.

16. The grid according to claim 13, wherein the first portion extends approximately 50 cm to 150 cm.

17. The grid according to claim 13, wherein each strand of said second portion has a width of approximately 10 cm to 40 cm.

18. The grid according to claim 13, wherein said first spacing is approximately 21 mm to 70 mm.

19. The grid according to claim 13, wherein said first spacing is approximately 21 mm to 70 mm, and wherein said individual threads of said at least one strand of said second portion are disposed side by side and joined together, and wherein said at least one strand of said second portion has a width of approximately 10 cm to 40 cm.

20. The grid according to claim 13, wherein said grid is comprised of a synthetic material.

21. The grid according to claim 13, wherein said tensile strength of said second portion is at least 8 times that of said tensile strength of said first portion.

22. The grid according to claim 13, wherein said second portion includes a plurality of strands and wherein a second spacing between adjacent strands of said second portion is greater than said first spacing between adjacent strands of said first portion.

23. The grid according to claim 22, wherein said first portion is disposed between two strands of said second portion.

24. The grid according to claim 22, wherein said second spacing is approximately 50 cm to 150 cm.

25. The grid according to claim 13, wherein each strand of said first portion includes a plurality of individual threads.

26. The grid according to claim 25, wherein the plurality of individual threads of each strand of said first portion are joined together.

27. The grid according to claim 25, wherein a number of individual threads of each strand of said first portion is less than a number of individual threads of each strand of said second portion.

* * * * *